US007164433B2

(12) United States Patent
Suzuki et al.

(10) Patent No.: US 7,164,433 B2
(45) Date of Patent: Jan. 16, 2007

(54) DISPLAY DEVICE, DISPLAY METHOD, PROGRAM RECORDING MEDIUM, AND PROGRAM

(75) Inventors: Kazuhiro Suzuki, Kanagawa (JP); Tetsu Kimura, Kanagawa (JP); Tetsuo Yutani, Kanagawa (JP)

(73) Assignee: Sony Corporation, Tokyo (JP)

( * ) Notice: Subject to any disclaimer, the term of this patent is extended or adjusted under 35 U.S.C. 154(b) by 299 days.

(21) Appl. No.: 10/097,214

(22) Filed: Mar. 12, 2002

(65) Prior Publication Data

US 2002/0149609 A1 Oct. 17, 2002

(30) Foreign Application Priority Data

Mar. 13, 2001 (JP) ..... 2001-071056

(51) Int. Cl.
*G09G 5/14* (2006.01)

(52) U.S. Cl. ..... 345/698; 345/672

(58) Field of Classification Search ..... 345/698, 345/699, 694, 3.1, 3.3, 660, 672
See application file for complete search history.

(56) References Cited

U.S. PATENT DOCUMENTS

| | | | | |
|---|---|---|---|---|
| 4,897,719 | A * | 1/1990 | Griffin | 375/240.12 |
| 4,962,465 | A * | 10/1990 | Saito et al. | 345/467 |
| 4,995,089 | A * | 2/1991 | Altrieth, III | 382/297 |
| 5,038,218 | A * | 8/1991 | Matsumoto | 358/296 |
| 5,042,075 | A * | 8/1991 | Sato | 382/299 |
| 5,045,967 | A * | 9/1991 | Igarashi | 345/589 |
| 5,388,166 | A * | 2/1995 | Onozawa | 382/269 |
| 5,402,148 | A * | 3/1995 | Post et al. | 345/698 |
| 5,590,247 | A * | 12/1996 | Mikuni | 358/1.11 |
| 5,596,689 | A * | 1/1997 | Tamura et al. | 345/661 |
| 6,002,810 | A * | 12/1999 | Wakisawa et al. | 382/298 |
| RE37,551 | E * | 2/2002 | Shiki | 345/87 |
| 6,426,771 | B1 * | 7/2002 | Kosugi | 348/222.1 |
| 6,493,467 | B1 * | 12/2002 | Okuda et al. | 382/260 |
| 6,584,237 | B1 * | 6/2003 | Abe | 382/299 |
| 6,639,625 | B1 * | 10/2003 | Ishida et al. | 348/218.1 |
| 6,654,031 | B1 * | 11/2003 | Ito et al. | 345/723 |
| 2001/0031093 | A1 * | 10/2001 | Fujiwara et al. | 382/240 |
| 2003/0058260 | A1 * | 3/2003 | Oshima et al. | 345/666 |

OTHER PUBLICATIONS

Interactive display of very large textures David Cline, Paris K. Egbert, Oct. 1998 ,Proceedings of the conference on Visualization '98 Publisher: IEEE Computer Society Press.*

Scale-dependent reproduction of pen-and-ink illustrations Mike Salisbury, Corin Anderson, Dani Lischinski, David H. Salesin Aug. 1996 ,Proceedings of the 23rd annual conference on Computer graphics and interactive techniques Publisher: ACM Press.*

* cited by examiner

*Primary Examiner*—Kee M. Tung
*Assistant Examiner*—J. Amini
(74) *Attorney, Agent, or Firm*—Oblon, Spivak, McClelland, Maier & Neustadt, P.C.

(57) ABSTRACT

A display device comprising a CPU 53, displays section 67 and a video memory 70. The video memory 70 stores data about the character data and image data that the application software processes in an absolute coordinate system. The display section 67 displays the character data and the image data, both based on the data stored in the video memory 70. The CPU 53 controls the writing of data from the application software into the video memory 70 and the reading of data from the video memory 70 to the display section 67.

9 Claims, 10 Drawing Sheets

FIG.7

Bitmap data file {
Header {
Attribute : 7byte
Resolution Flag : 1Byte
}
Bit Map Data ( ) : N Byte
}

PDA WILL QUICKLY STARTS OPERATING WHEN YOU TURN ON THE POWER SWITCH. PDA CAN BE CONNECTED TO A PERSONAL COMPUTER EASILY.

ADDRESS DISPLAY

NAME: ○○ ××

ADDRESS: XXXX, YYYY CITY

PHONE: 000-111-222

HOBBIES: PLAYING SOCCER

DISPLAY DEVICE, DISPLAY METHOD, PROGRAM RECORDING MEDIUM, AND PROGRAM

BACKGROUND OF THE INVENTION

1. Field of the Invention

The present invention relates to a display device for displaying the character data and image data generated by application software and to a display method of displaying such character data and image data. The invention also relates to a program for use in the display method and a medium that records the program.

2. Description of the Related Art

A system is known, which comprises a display device the full screen of which is composed of 160×160 (K=L=160) pixels. The system uses application software that processes the (x, y) coordinates of the pixels in a 160×160 absolute coordinate system. Let us assume that various items of application software have been prepared for use in the system, and that the system has been modified and has its full-screen resolution increased to the value of 320×320 (M=N=2). In this case, the coordinates of the pixels are processed in their absolute values when the existing application software is executed in the modified new system. As a consequence, the pixels are displayed in a 160×160 pixel region of the 320×320 full-screen as is illustrated in FIG. 1B. In other words, an image is displayed on the 320×320 full-screen, in a size four times as small as on the full screen of the old system. To display the image exactly in the same way as on the display device of the old system, the existing application software must be modified to the specification of the new system that has the full-screen resolution of 320×320 pixels.

To prepare new application software to display data at high resolution, all display components used must be modified in order to display images at high resolution.

BRIEF SUMMARY OF THE INVENTION

The present invention has been made in view of the foregoing. An object of the invention is to provide a display device and a display method that can display images at high resolution in a new system even if the new system executes the existing application software for low-resolution display, without the necessity of modifying the existing application software.

Another object of this invention is to provide a display device and a display method that enable programmers to write new application software for displaying images at high resolution, without necessity of modifying the display components in order to display images at high resolution.

Another object of the invention is to provide a program relating to the display method described above and a medium recording the program.

A display device according to the present invention is configured to display character data and image data, both generated by application software. The display device comprises: data storage means for storing data about character data and image data, both processed in an absolute coordinate system by the application software; image-displaying means for displaying the data stored into the data storage means; and control means for controlling the writing of the data from the application software into the data storage means and the reading of the data from the data storage means into the image-displaying means. The control means controls the writing of the data from the application software into the data storage means, such that each one-pixel data item is copied at magnification N in vertical direction and magnification M in horizontal direction.

A display device according to the invention is designed to display character data and image data, both generated by application software. This display device comprises: data storage means for storing data about character data and image data, both processed in an absolute coordinate system by the application software; image-displaying means for displaying the data stored into the data storage means; and control means for controlling the writing of the data from the application software into the data storage means and the reading of the data from the data storage means into the image-displaying means. The control means controls the writing of the data from the application software into the data storage means, such that the data is written in units of pixels without changing resolution, in an storage area magnified N pixel-times in vertical direction and M pixel-times in horizontal direction.

A display device according to this invention is designed to display character data and image data, both generated by application software. The display device comprises: data storage means for storing data about character data and image data, both processed in an absolute coordinate system by the application software; image-displaying means for displaying the data stored into the data storage means; and control means for controlling the writing of the data from the application software into the data storage means and the reading of the data from the data storage means into the image-displaying means. The control means controls the reading of the data from the data storage means into the image-displaying means, such that the same pixel data is read M times in horizontal direction and N times in vertical direction.

A display device according to the invention is configured to display character data and image data, both generated by application software. The display device comprises: data storage means for storing data about character data and image data, both processed in an absolute coordinate system by the application software; image-displaying means for displaying the data stored into the data storage means, at resolutions of N×K and M×L pixels in vertical direction and horizontal direction, respectively, when the application software processes the data in a K×L absolute coordinate system; and control means for controlling the writing of the data from the application software into the data storage means and the reading of the data from the data storage means into the image-displaying means.

A display method according to this invention is designed to display character data and image data at an image-displaying device, both generated by application software. The method comprises the steps of: writing data about character data and image data into a data-recording medium, said character data and said image data having been processed in an absolute coordinate system by the application software; reading the data from the data-recording medium to the image-displaying device; and controlling the writing of the data from the application software into the data-recording medium, such that each one-pixel data item is copied at magnification N in vertical direction and magnification M in horizontal direction.

A display method according to the present invention is designed to display character data and image data at an image-displaying device, both generated by application software. This method comprises the steps of: writing data about character data and image data into a data-recording medium, said character data and said image data having been processed in an absolute coordinate system by the application software; reading the data from the data-recording medium to the image-displaying device; and controlling the writing of the data from the application software into the data-recording medium, such that the data is written in units of pixels without changing resolution, in an storage area magnified N pixel-times in vertical direction and M pixel-times in horizontal direction.

A display method according to the invention is devised to display character data and image data at an image-displaying device, both generated by application software. The display method comprises the steps of: writing data about character data and image data into a data-recording medium, said character data and said image data having been processed in an absolute coordinate system by the application software; and reading the data from the data-recording medium to image-displaying device, and controlling the reading of the data from the data-recording medium to the image-displaying device, such that the same pixel data is read M times in horizontal direction and N times in vertical direction.

A display method according to this invention is designed to display character data and image data at an image-displaying device, both generated by application software. The display method comprises the steps of: writing data about character data and image data into a data-recording medium, said character data and said image data having been processed in an absolute coordinate system by the application software; and displaying the data written into the data-recording medium at the image-displaying device, at resolutions of N×K and M×L pixels in vertical direction and horizontal direction, respectively, when the application software processes the data in a K×L absolute coordinate system, wherein the writing of the data from the application software into the data-recording medium and the reading of the data from the data-recording medium into the image-displaying device is controlled.

A program according to the present invention describes a method of displaying character data and image data at an image-displaying device, both generated by application software. The method comprises the steps of: writing data about character data and image data into a data-recording medium, said character data and said image data having been processed in an absolute coordinate system by the application software; reading the data from the data-recording medium to the image-displaying device; and controlling the writing of the data from the application software into the data-recording medium, such that each one-pixel data item is copied at magnification N in vertical direction and magnification M in horizontal direction.

A program according to the invention describes a method of displaying character data and image data at an image-displaying device, both generated by application software. The method comprises the steps of: writing data about character data and image data into a data-recording medium, said character data and said image data having been processed in an absolute coordinate system by the application software; reading the data from the data-recording medium to the image-displaying device; and controlling the writing of the data from the application software into the data-recording medium, such that the data is written in units of pixels without changing resolution, in an storage area magnified N pixel-times in vertical direction and M pixel-times in horizontal direction.

A program according to this invention describes a method of displaying character data and image data at an image-displaying device, both generated by application software. The method comprises the steps of: writing data about character data and image data into a data-recording medium, said character data and said image data having been processed in an absolute coordinate system by the application software; and reading the data from the data-recording medium to image-displaying device, and controlling the reading of the data from the data-recording medium to the image-displaying device, such that the same pixel data is read M times in horizontal direction and N times in vertical direction.

A program according to the present invention describes a method of displaying character data and image data at an image-displaying device, both generated by application software. The method comprises the steps of: writing data about character data and image data into a data-recording medium, said character data and said image data having been processed in an absolute coordinate system by the application software; and displaying the data written into the data-recording medium at the image-displaying device, at resolutions of N×K and M×L pixels in vertical direction and horizontal direction, respectively, when the application software processes the data in a K×L absolute coordinate system. In the method, the writing of the data from the application software into the data-recording medium and the reading of the data from the data-recording medium into the image-displaying device is controlled.

The display device and display method according to the present invention can execute the existing low-resolution display application software in the new system designed to display images at high resolution. They can display data in the full-screen mode, without modifying the existing application software.

Moreover, the display components used need not be modified to display images at high resolution, in order to prepare new application software for displaying data at high resolution.

BRIEF DESCRIPTION OF THE SEVERAL VIEWS OF THE DRAWING

PIGS. 1A and 1B show images displayed on the screen of a conventional display device;

FIG. 7 is a diagram representing the bit-map data to be displayed at high resolution;

DETAILED DESCRIPTION OF THE INVENTION

An embodiment of the present invention will be described, with reference to the accompanying drawings. The embodiment is a personal digital assistant (PDA) 1 shown in FIGS. 2A and 2B that are respectively a plan view and a side view. The personal digital assistant 1 can perform ordinary PIM (Personal Information Management) functions such as electronic schedule management, electronic address management, electronic memo pad and activity list management. The functions can be performed not only within the personal digital assistant 1, but also in combination with the software installed in personal computers.

Figure 1A:
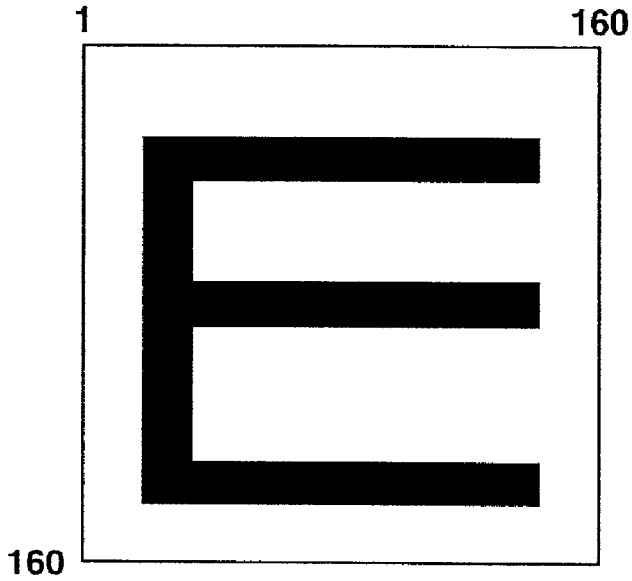
Figure 1B:
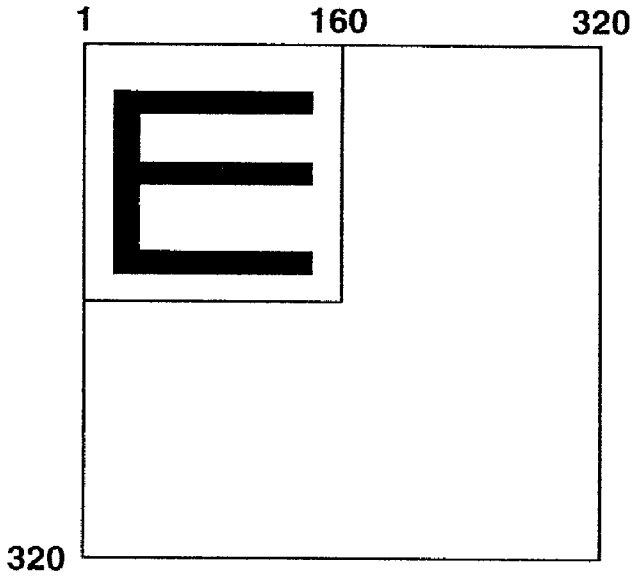
Figures 2A, 2B:
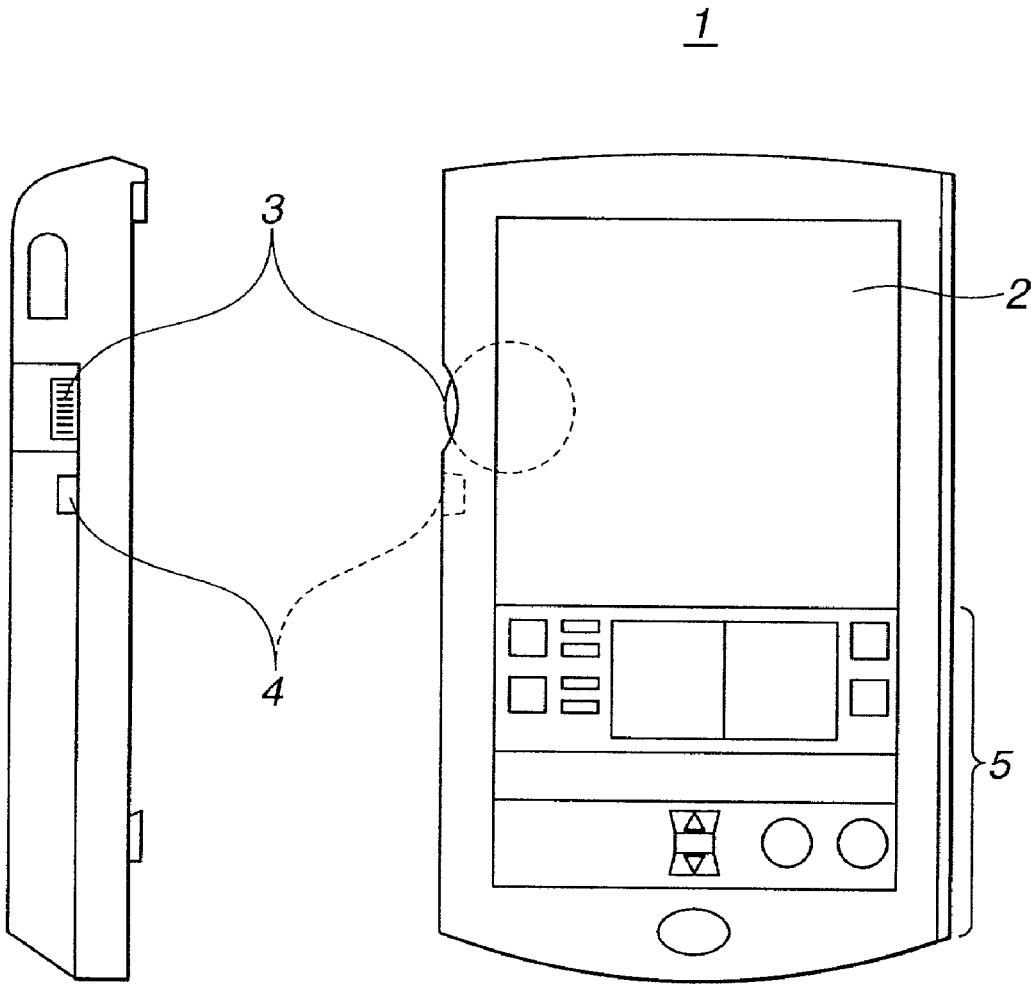
FIG. 2A is a plan view of a personal digital assistant.
FIG. 2B is a side view of the personal digital assistant.

As FIG. 2A shows, the personal digital assistant 1 has a display section 2 on the front. The display section 2 is, for example, a liquid crystal display (LCD) panel. The section 2 can display a start menu for activating application software and performing various processes, image data and character data, information about sound and music to be reproduced, operation guide messages, and menu screens for reproducing and editing data.

The personal digital assistant 1 has an operation section 5 on the front, below the display section 2. The operation section 5 includes keys, a writing pad and the like. The writing pad is designed to input characters when the user write the characters on the pad with a pen. The display section 2 displays a touch panel having buttons and the like. The buttons function as picture-drawing objects. The user may touch any button displayed, with a pen or the finger.

As FIG. 2B shows, a jog dial 3 and a back button 4 are provided on the left side of the personal digital assistant 1. The user may rotate and push the jog dial 3 and may push the back button 4 to terminate the process initiated by pushing the jog dial 3.

Figure 3:
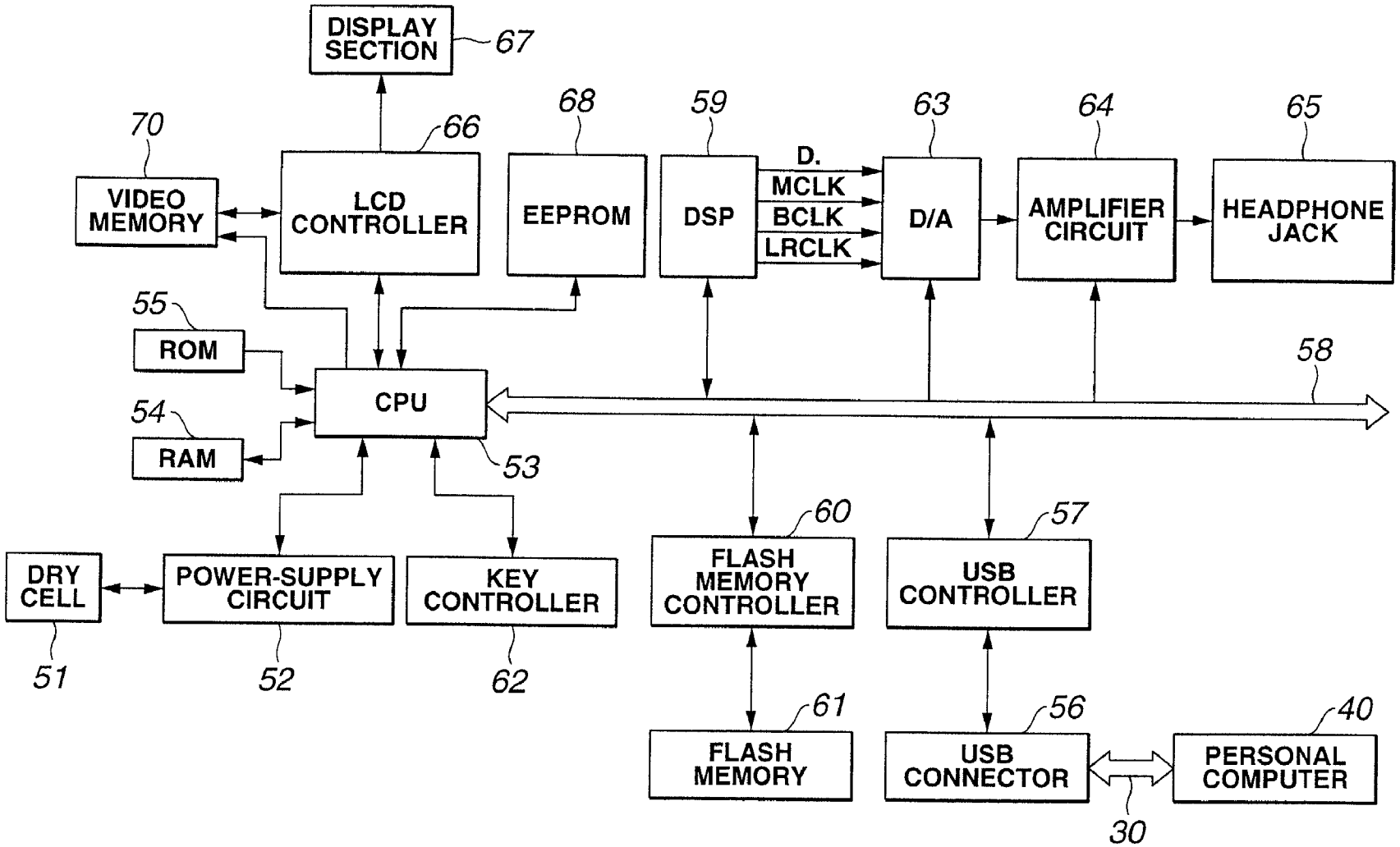
FIG. 3 is a block diagram of the personal digital assistant.

FIG. 3 shows the configuration of the personal digital assistant 1. The personal digital assistant 1 has a CPU 53 and a display section 67 (i.e., display section 2). The CPU 53 executes application software, generating character data and image data. The display section 67 displays the character data and the image data at resolution of NK×ML pixels even if the application software processes the data in an absolute coordinate system of K×L (=160×160).

To enable the display section 67 to display the data at the resolution NK×ML pixels, the personal digital assistant 1 comprises a video memory 70, in addition to the CPU 53 and the display section 67. The video memory 70 stores character data and image data that the application software has processed in the absolute coordinate system. The display section 67 displays the character data and the image data, both stored in the video memory 70. The CPU 53 controls the writing of the data from the application software into the video memory 70 and the reading of data from the video memory 70 to the display section 67. How the CPU 53, display section 67 and video memory 70 operate will be described later in detail.

The personal digital assistant 1 will be described in detail.

In the personal digital assistant 1, a bus 58 connects a UBS controller 57, a DSP 59, a flash memory controller 60, a D/A converter 63 and an amplifier circuit 64 to the CPU 53. The CPU 53 is connected to a power-supply circuit 52, a RAM 54, a ROM 55, a key controller 62, an EEPROM 68 and an LCD controller 66, too.

The CPU 53 is the unit that executes the operating system (OS) and the application software. More specifically, the OS and the application software are read from the ROM 55 and stored into the RAM 54, and the CPU 53 executes the OS and the application software temporarily stored in the RAM 54. As indicated above, the CPU 53 controls the writing of data from the application software into the video memory 70 and the reading of data from the video memory 70 to the display section 67.

The personal digital assistant 1 incorporates a dry cell 51. The dry cell 51 applies the power-supply voltage to the power-supply circuit 52. The circuit 52 converts the voltage to an internal power-supply voltage. The internal power-supply voltage is applied to the CPU 53, the display section 67 and some other components, whereby the personal digital assistant 1 is driven.

The UBS controller 57 may be connected to a personal computer 40 by a UBS connector 56 through a USB cable 30. In this case, the UBS controller 57 receives the contents transferred from the personal computer 40 and supplies the contents to the CPU 53 through the bus 58.

A flash memory 61 is inserted as a memory card into the personal digital assistant 1. The flash memory 61 has a storage capacity of about 64 Mbytes and can store contents. It stores playback codes that are used to expand the contents that have been compressed in a prescribed data-compressing scheme. The flash memory 61 can be removed from the personal digital assistant 1. When inserted into the personal digital assistant 1, the flash memory 61 is connected to the bus 58 via the flash memory controller 60.

The DSP 59 functions as an audio-data processing section to reproduce audio data. It receives the audio data read from the flash memory 61 and decodes the audio data. The audio data decoded is supplied to the D/A converter 63. The DSP 59 is formed integral with the transmitting circuit that is incorporated in the personal digital assistant 1. A quartz oscillator 59A is connected to the DPS 59. The DSP 59 receives a master clock signal MCLK from the quartz oscillator 59A. Using the master clock signal MCLK, the DPS 59 reproduces the audio data. The DPS 59 incorporates an oscillator that generates a bit clock signal BCLK of a predetermined frequency and an L-channel clock signal LRCLK, from the master clock signal MCLK. The bit clock signal BCLK and the L-channel clock signal LRCLK are supplied to the D/A converter 63.

The D/A converter 63 converts the audio data to an analog audio signal, which is supplied to the amplifier circuit 64. The amplifier circuit 64 amplifies the audio signal, which is supplied to a headphone (not shown) via a headphone jack 65.

The key controller 62 receives the operation commands from the keys, a writing pad and the like that are illustrated in FIGS. 2A and 2B.

The LCD controller 66 is connected between the CPU 53 and the display section 67. The LCD controller 66 receives the character data or the image data that the CPU 53 has generated by executing the application software and stored into the video memory 70. The LCD controller 66 supplies the character data or the image data to the display section 67. The display section 67 displays the data that the CPU 53 has generated by using the application software.

It will be described how the personal digital assistant 1 operates as a display. Assume that the application software processes the data the (x, y) coordinates of the pixels in a 160×160 absolute coordinate system. In this case, the display section 67 displays the data stored into the video memory 70 at a resolution of 320 (=2×160, vertical)×320 (=2×160, horizontal) pixels.

The CPU 53 controls the writing of data from the application software into the video memory 70 and the reading of data from the video memory 70 to the display section 67.

More precisely, the CPU 53 controls some other components so that the personal digital assistant 1 may operate in four modes, as will be described below.

Figures 4A, 4B, 4C:
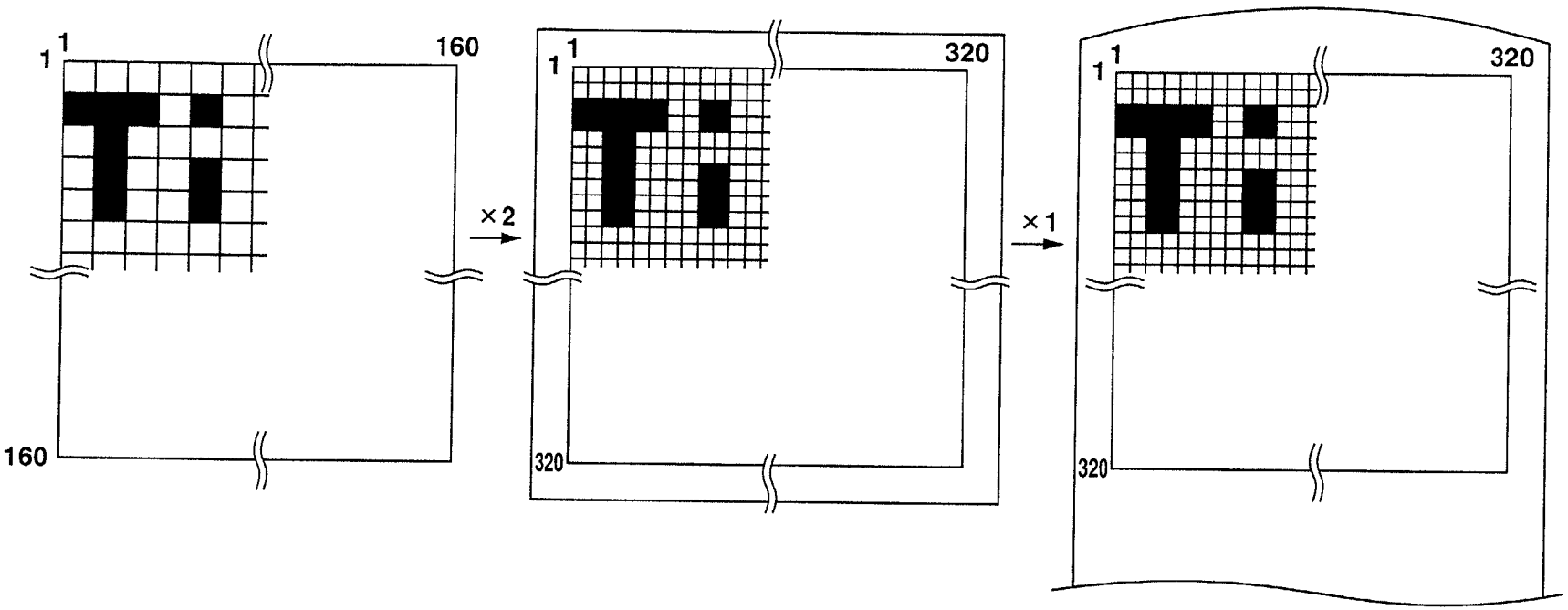
FIGS. 4A to 4C are diagrams explaining how the personal digital assistant operates in the first mode.

First, how the personal digital assistant 1 operates in the first mode will be explained with reference to FIGS. 4A to 4C.

In the first mode, the assistant 1 copies each pixel in magnification N in the vertical direction and magnification M in the horizontal direction before the application software writes the character data into the video memory 70. In this instance, M=N=2. As FIG. 4A shows, the application software, which is executed by the CPU 53, processes character data representing "Ti" in a 160×160 absolute coordinate system. Before the application software writes the character data into the video memory 70, the CPU 53 executes the OS or middle-ware program, thus copying each pixel in the magnification N (=2) in the vertical direction and the magnification M (=2) in the horizontal direction. That is, the pixel is magnified twice the original size, in both the vertical direction and the horizontal direction. Therefore, the data representing "Ti" is written, in a proper size, into the video memory 70 as is illustrated in FIG. 4B. The data is supplied from the video memory 70 via the LCD controller 66 to the display section 67. The display section 67 displays "Ti" in the original size as shown in FIG. 4C.

Figures 5A, 5B, 5C:
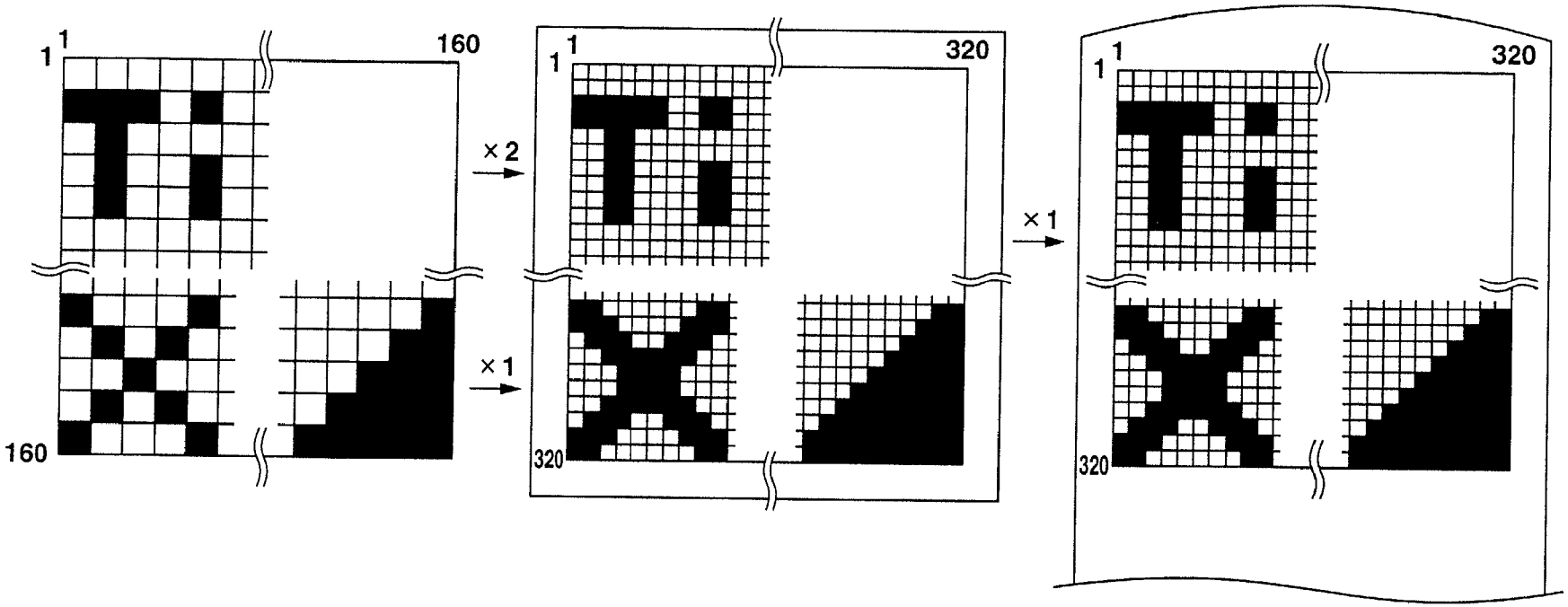
FIGS. 5A to 5C are diagrams explaining how the personal digital assistant operates in the second and third display modes.

How the personal digital assistant 1 operates in the second mode to represent character data and image data will be described, with reference to the lower half of FIG. 5A.

The assistant 1 represents character data in the second mode in the following manner. As shown in the lower-left part of FIG. 5A, the application software processes character data representing letter "X" in a 160×160 absolute coordinate system. To enable the application software to write the character data, "X", into the video memory 70, the OS or middle-ware program use the font that is appropriate for the character "X" to be represented at a resolution of 320×320 pixels. Hence, the character can be displayed in high quality, without revising the application software at all.

How the personal digital assistant 1 represents image data in the second mode will be described. As illustrated at the lower-right part of FIG. 5A, the application software being executed by the CPU 53 processes the data that represents a right-angled triangle with a slope extending upward to the right, in a 160×160 absolute coordinate system. To enable the application software to write the image data into the video memory 70, the OS or middle-ware program process the image data, thus representing the image at a resolution of 320×320 pixels. Thus, the image can be displayed in high quality, without revising the application software at all.

How the personal digital assistant 1 operates in the third mode will be described, with reference to FIGS. 5A to 5C.

In the third mode, data items representing pixels are written into the video memory 70, in which the data items are copied in magnification of 2 in both the vertical direction and the horizontal direction. Therefore, the data items are stored in the memory 70 at different resolutions. More specifically, the middle-ware program writes the character data representing "Ti," shown at the upper half of FIG. 5A, into video memory 70 in the first mode. As FIG. 5B shows, the character data written in the memory 70 is magnified twice in both the vertical direction and the horizontal direction. The character data is read to the LCD 67 in its original size (namely, in magnification of 1). Meanwhile, the image data representing a right-angled triangle with a slope extending upward to the right is written into the video memory 70 in the second mode, at resolution of 320.times.320 pixels. The character data is read to the LCD 67 in its original size (namely, in magnification of 1).

It will be described how the personal digital assistant 1 operates in the fourth mode.

Figures 6A, 6B, 6C:
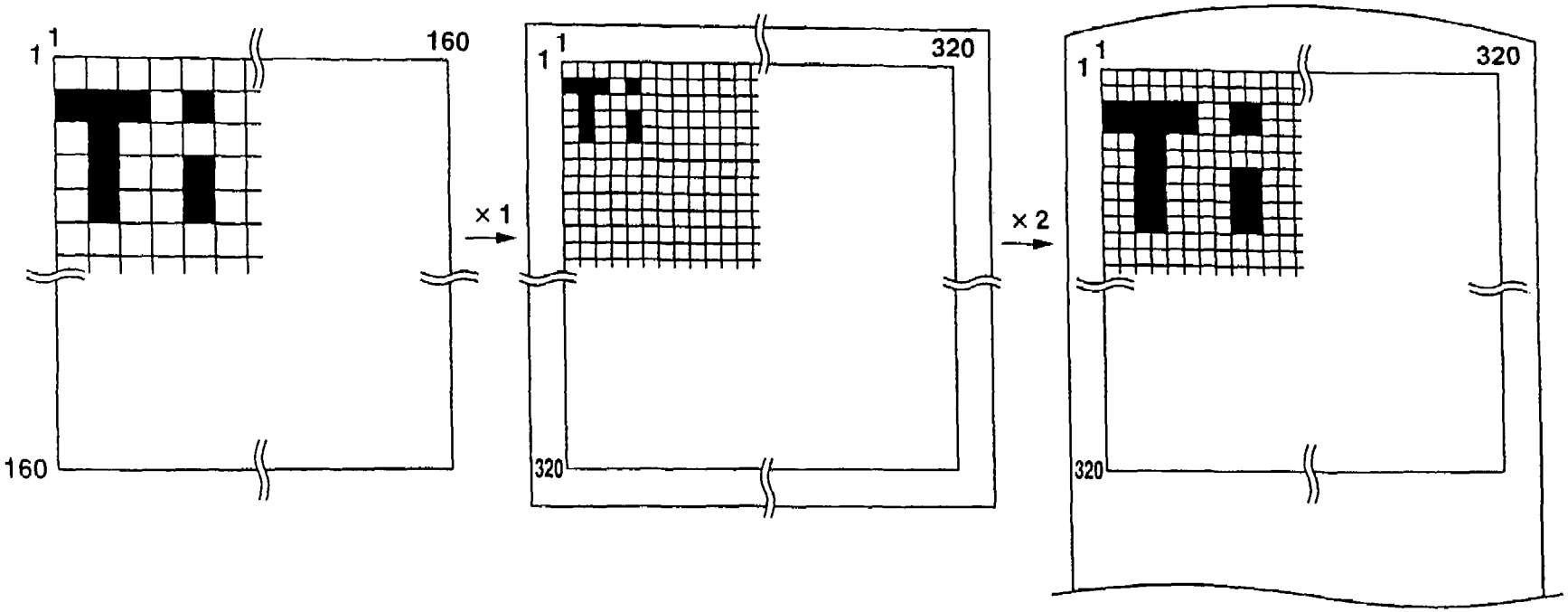
FIGS. 6A to 6C are diagrams explaining how the personal digital assistant operates in the fourth display mode.

In the fourth mode, character data is read into the display section 67 from the video memory 70 through the LCD controller 66, each pixel data item read M times in the horizontal direction and read N times in the vertical direction. In the fourth mode, too, M=N 2. To be more specific, as FIG. 6A shows, the application software being executed by the CPU 53 processes the character data that represents "Ti", in a 160×160 absolute coordinate system. The application software writes the character data representing "Ti" into the video memory 70, in its original size (namely, in magnification of 1), as is illustrated in FIG. 6B. As FIG. 6C shows, the character data is read into the display section 67 from the video memory 70 through the LCD controller 66, each pixel data item read twice in the horizontal direction and twice in the vertical direction. "Ti" is therefore displayed as is shown in FIG. 6C.

The second and third modes derive from the first mode; they fall within the scope of the first mode. The fourth mode greatly differs from the first mode.

The CPU 53 controls the other components so that the personal digital assistant 1 may operate in the first mode to the fourth mode. When the application software prepared to display images of 160×160 pixels is executed in the fourth mode, the personal digital assistant 1 works well as a display device for displaying images of 160×160 pixels.

Even if the software is executed in the first mode under the control of the CPU 53, the personal digital assistant 1 operates exactly in the same way, provided that the assistant 1 provides the data to be written in the display area, in the form of a middle-ware program.

The application software can work as a program for display characters of high quality, without being modified at all, if three conditions are satisfied. First, the software is executed in the second mode. Second, the data to be written in the display area is available in the form of a middle-ware program. Third, the character-writing part of the middle-ware program is designed to write characters into the video memory 70, in the font having the resolution of 320×320 pixels.

Not only characters, but also images can be displayed at the resolution of 320×320 pixels, by executing the software for displaying data at resolution of 160×160 pixels, only if the image are represented at the high resolution of 320×320 pixels.

In the third mode, the personal digital assistant 1 can display characters of the first mode and images of the second mode at the same time.

The CPU 53 may determine in which mode the personal digital assistant 1 should be operated, the fourth mode or the first mode. If this is the case, the user can utilize software, caring nothing about the mode in which the personal digital assistant 1 is operating.

This is useful in the case where the user want to use any application software that cannot work in the first mode. The user may wish to use software that makes direct access to a 160×160 video memory and cannot work in the first mode. Such software may be executed in the fourth mode.

Most application software items write data into video memories via API. However, game software, for example, writes data directly into a video memory in order to increase the speed of drawing pictures. Consequently, the system connected to the output of the API cannot write the data in magnifications M and N into the video memory, and the display section cannot display the data in the desired manner. Such software is therefore executed in the fourth mode.

Any software that is not of the problematical type described above can serve, if executed in the first mode, to display characters at resolution twice as high even though it is designed for 160×160 video memories.

Unless most of the software items installed in the personal digital assistant 1 are not of problematical type, the assistant 1 may be default-set in the first mode. In this case, the user only needs to switch the mode, from the first mode to the fourth mode when the data is not displayed as is desired. Alternatively, the personal digital assistant 1 may be default-set in the fourth mode, and the user may switch the mode to the first mode when the data is not displayed as is desired. Once the software is found to work well, the display section holds the data and automatically changes it so that the software may work in the first mode.

The application software may contain attributed data that designate either the fourth mode or the first mode. In this case, if the CPU 53 reads the attribute data while executing the application software and automatically changes switches the mode to a new one, the display section can then display data in the new mode.

The high-resolution display implemented in the second mode derived from the first mode, and the normal display implemented in the first mode, will be described in comparison.

FIG. 7 illustrates the bitmap data for use in the high-resolution display. The attribute contains the attribute data item representing the size of the bitmap. This attribute data item adds a resolution flag.

If the resolution flag is 0, the bitmap data is one designed for high-resolution display. In this case, the bitmap data is written into the video memory in magnification of 1 in both the horizontal direction and the vertical direction. Data can therefore be displayed at high resolution.

If the resolution flag is 1, the bitmap data is one designed for normal-resolution display. In the normal display mode, the bitmap data is copied in magnification of 2 in both the horizontal direction and the vertical direction. The bitmap data is then stored into the video memory.

Figure 8:
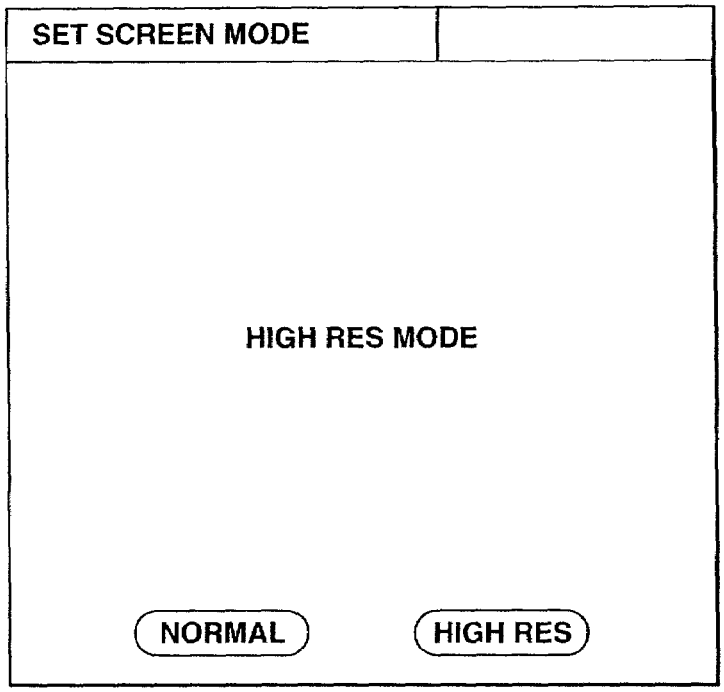
FIG. 8 shows a menu for selecting the high-resolution display mode or the normal display mode, which is displayed on the screen of the personal digital assistant.
Figure 9:
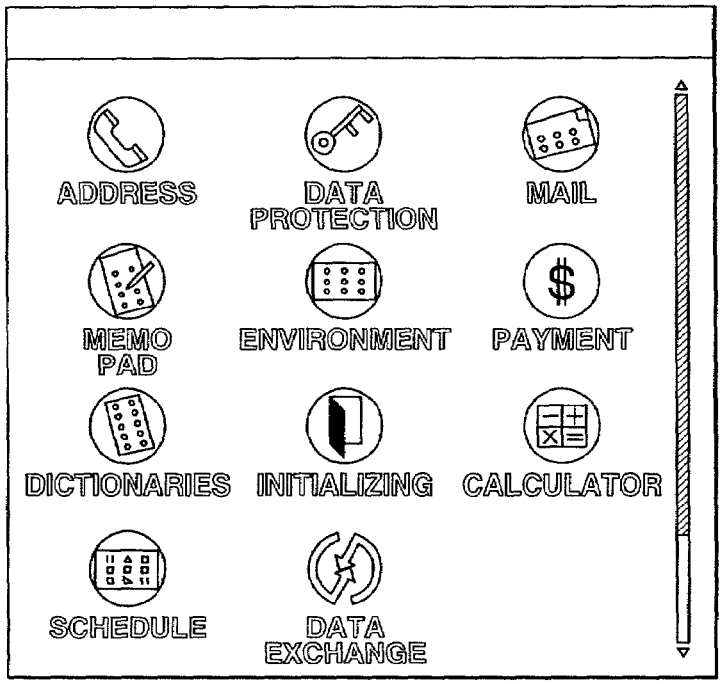
FIG. 9 illustrates a menu displayed in the normal display mode.
Figure 10:
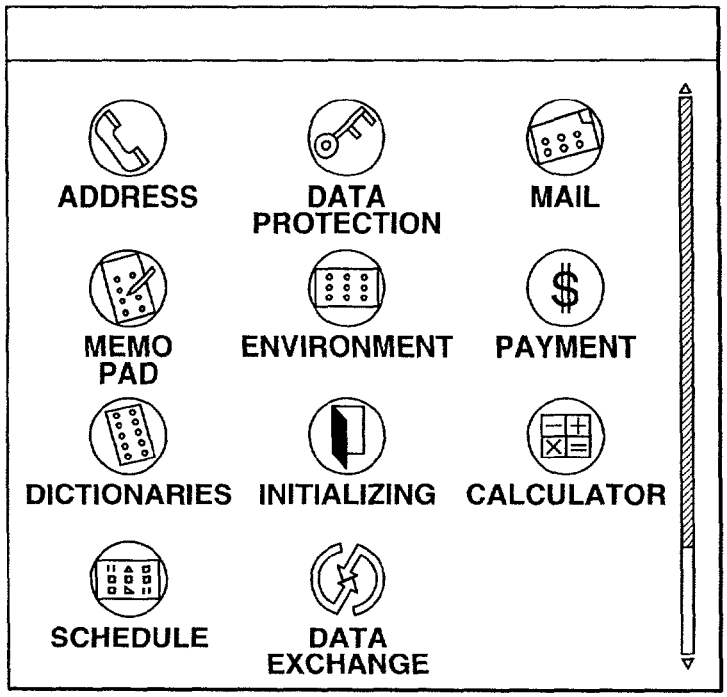
FIG. 10 depicts the menu displayed in the high-resolution display mode.
Figure 11:
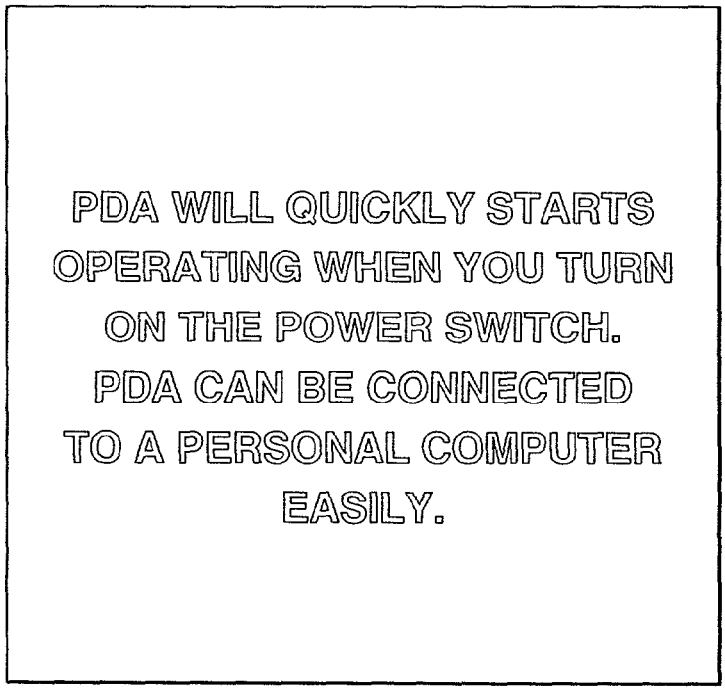
FIG. 11 shows character data displayed in the normal display mode.

FIG. 8 shows a menu displayed on the screen of the personal digital assistant 1. The user can use the menu to select the high-resolution display mode or the normal display mode. If the user selects the normal display mode, the display section 2 will show first the menu shown in FIG. 9 and then the character data shown in FIG. 11. If the user selects the high-resolution display mode, the display section 2 will show first the menu shown in FIG. 10 and then the character data shown in FIG. 12.

Figures 12, 13:
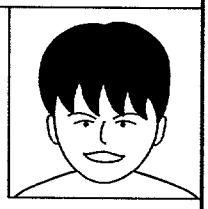
FIG. 12 shows the character data displayed in the high-resolution display mode.
FIG. 13 illustrates data displayed in the third mode.

FIG. 13 illustrates an example of data that the display section 2 displays in the third mode. The data displayed is the address of a person and the portrait of the person. The character data is displayed in the first mode, whereas the image data (i.e., the portrait) is displayed in the second mode.

As has been described, the personal digital assistant 1 can function as a display device that can execute the existing, low-resolution display application software to display data at high resolution by using the new system. The personal digital assistant 1 can display the data on the full screen, without being modified at all.

Furthermore, new application software for achieving high-resolution display can be prepared, without modifying the display components in order to display images at high resolution.

The embodiment described above operates in two ore more modes (i.e., first to fourth modes) at the same time. Nonetheless, the present invention can provide a display device that operates in one mode at a time.

The embodiment described above is a personal digital assistant. The present invention can be applied to a mobile telephone with many functions, nevertheless.

A display method according to the present invention may be used in mobile telephones and personal digital assistants of the type described above. If used in a mobile telephone or a personal digital assistant, the method can achieve the advantages described above. In addition, the personal digital assistant can attain similar advantages if the CPU provided in it reads the program describing the data processing method from a recording medium and then executes the program.

What is claimed is:

1. A display device for displaying character data and image data, both generated by application software, comprising:

a data storage unit configured to store the character data and image data, both processed in an absolute coordinate system by the application software;

a display unit configured to display the data stored in the data storage unit; and a control unit configured to control the writing of the data from the application software into the data storage unit and reading the data from the data storage unit into the display unit, wherein the control unit controls the writing of first data from the application software into the data storage unit, while copying each one-pixel data item at magnification N in a vertical direction and magnification M in a horizontal direction, and the writing of second data into the data storage unit, without the second data being magnified at all, wherein the display unit displays the first data and the second data simultaneously at different resolutions when the display unit has resolutions of N×K and M×L pixels in the vertical direction and the horizontal direction, respectively, and the application software processes the data in a K×L absolute coordinate system.

2. The display device according to claim 1, wherein said first data is the character data and said second data is the image data.

3. The display device according to claim 2, wherein said data storage unit stores information indicating whether the image data and character data are magnified.

4. A display method for displaying character data and image data, both generated by application software, comprising the steps of:

storing the character data and image data, both processed in an absolute coordinate system by the application software;

displaying the data stored in the data storage unit; and controlling the writing of the data from the application software into the data storage unit and reading the data from the data storage unit into the display unit, wherein the control unit controls the writing of first data from the application software into the data storage unit, while copying each one-pixel data item at magnification N in a vertical direction and magnification M in a horizontal direction, and the writing of second data into the data storage unit, without the second data being magnified at all, wherein the display unit displays the first data and the second data simultaneously at different resolutions when the display unit has resolutions of N×K and M×L pixels in the vertical direction and the horizontal direction, respectively, and the application software processes the data in a K×L absolute coordinate system.

5. The display method according to claim 4, wherein said first data is the character data and said second data is the image data.

6. The method according to claim 5, wherein the step of storing includes storing information indicating whether the image data and character data are magnified.

7. A computer readable storage medium having a program stored therein for the purpose of performing a method of displaying character data and image data, both generated by application software, the method comprising the steps of:

storing the character data and image data, both processed in an absolute coordinate system by the application software;

displaying the data stored in the data storage unit; and controlling the writing of the data from the application software into the data storage unit and reading the data from the data storage unit into the display unit, wherein the control unit controls the writing of first data from the application software into the data storage unit, while copying each one-pixel data item at magnification N in a vertical direction and magnification M in a horizontal direction, and the writing of second data into the data storage unit, without the second data being magnified at all, wherein the display unit displays the first data and the second data simultaneously at different resolutions when the display unit has resolutions of N×K and M×L pixels in the vertical direction and the horizontal direction, respectively, and the application software processes the data in a K×L absolute coordinate system.

8. The computer readable storage medium according to claim 7, wherein said first data is the character data and said second data is the image data.

9. The computer readable storage medium according to claim 8, wherein the step of storing includes storing information indicating whether the image data and character data are magnified.

* * * * *